US005462510A

United States Patent [19]

Ish, III

[11] Patent Number: 5,462,510

[45] Date of Patent: Oct. 31, 1995

[54] SINGLE EFFORT, DOUBLE ACTION EXERCISE BENCH

[75] Inventor: A. Buell Ish, III, Carnation, Wash.

[73] Assignee: Vectra Fitness, Inc., Redmond, Wash.

[21] Appl. No.: 283,578

[22] Filed: Aug. 1, 1994

[51] Int. Cl.[6] ..... A63B 26/00

[52] U.S. Cl. ..... 482/142; 482/134; 482/908; 297/316; 297/319

[58] Field of Search ..... 482/93, 94, 97–104, 482/95, 96, 133–138, 142, 908, 139; 297/316, 319, 365, 366, 372, 328; 606/245

[56] References Cited

U.S. PATENT DOCUMENTS

| | | | |
|---|---|---|---|
| Re. 34,572 | 3/1994 | Johnson et al. | 482/138 |
| 1,028,548 | 6/1912 | Cromer | 297/319 |
| 2,673,736 | 3/1954 | Fiumeduro | 482/142 |
| 4,546,967 | 10/1985 | Kecala | 482/97 |
| 4,566,691 | 1/1986 | Mahnke | 482/104 |
| 4,635,934 | 1/1987 | Roethke | 482/104 |
| 4,826,158 | 5/1989 | Fields, Jr. | 482/142 |
| 4,871,166 | 10/1989 | Sterba et al. | 482/142 |
| 5,060,939 | 10/1991 | Oswald et al. | 482/142 |
| 5,069,447 | 12/1991 | Snyderman et al. | 482/104 |
| 5,273,505 | 12/1993 | Jones | 482/142 |

*Primary Examiner*—Richard J. Apley
*Assistant Examiner*—Victor K. Hwang
*Attorney, Agent, or Firm*—Stephen M. Evans; David L. Garrison

[57] ABSTRACT

A multiple inclination exercise bench having a torso supporting assembly and a seat supporting assembly is disclosed wherein the elevation by a user of the torso supporting assembly causes the elevation of the seat supporting assembly. The invention is characterized as having a torso supporting assembly mechanically linked to a seat supporting assembly. In preferred form, the torso supporting assembly is pivotal at its proximal end about a point associated with the bench and has associated therewith at least one cam plate. A lever or rocker arm is pivotally located adjacent to the cam plate and has a cam follower attached thereto at one end, and a seat support member at the other end. The seat support member supports the distal end of the seat supporting assembly where the proximal end is pivotally located on the bench. A support member is associated with the torso supporting assembly to maintain a desired inclination thereof. In an embodiment of the invention, a pair of struts are pivotally mounted to the distal portion of the torso supporting assembly and engage via a locking mechanism with the bench structure.

9 Claims, 4 Drawing Sheets

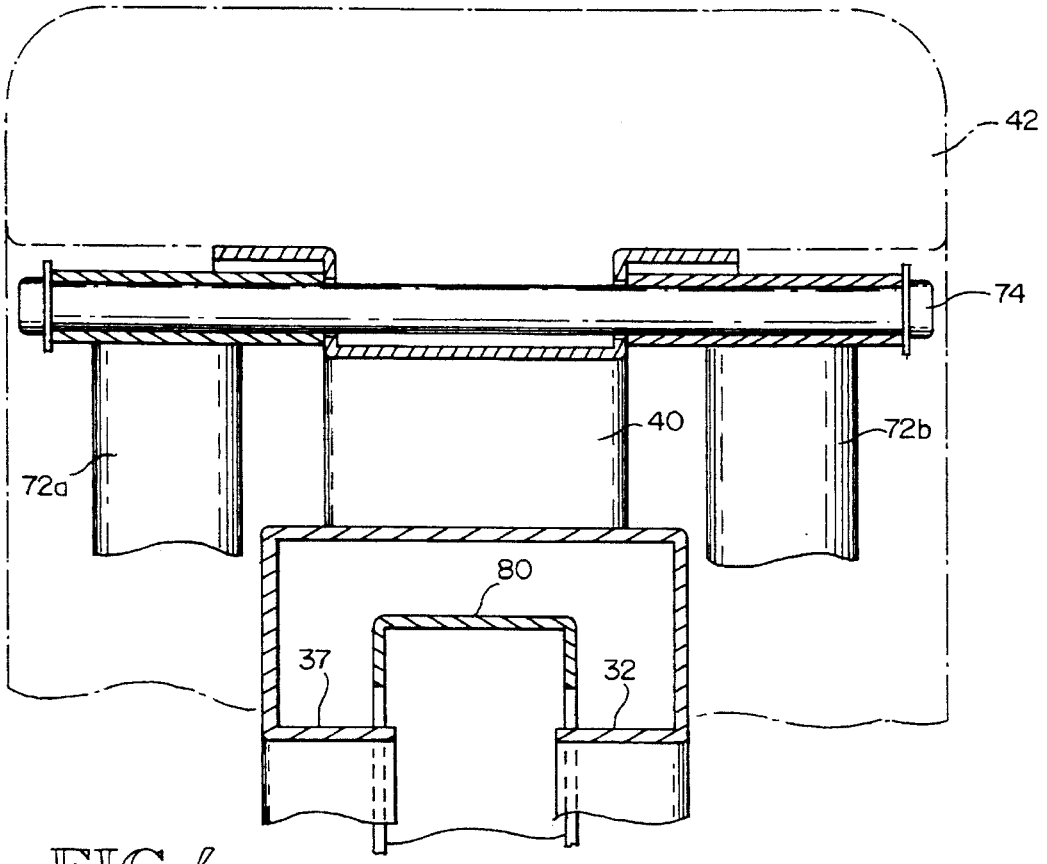
FIG. 4
FIG. 5
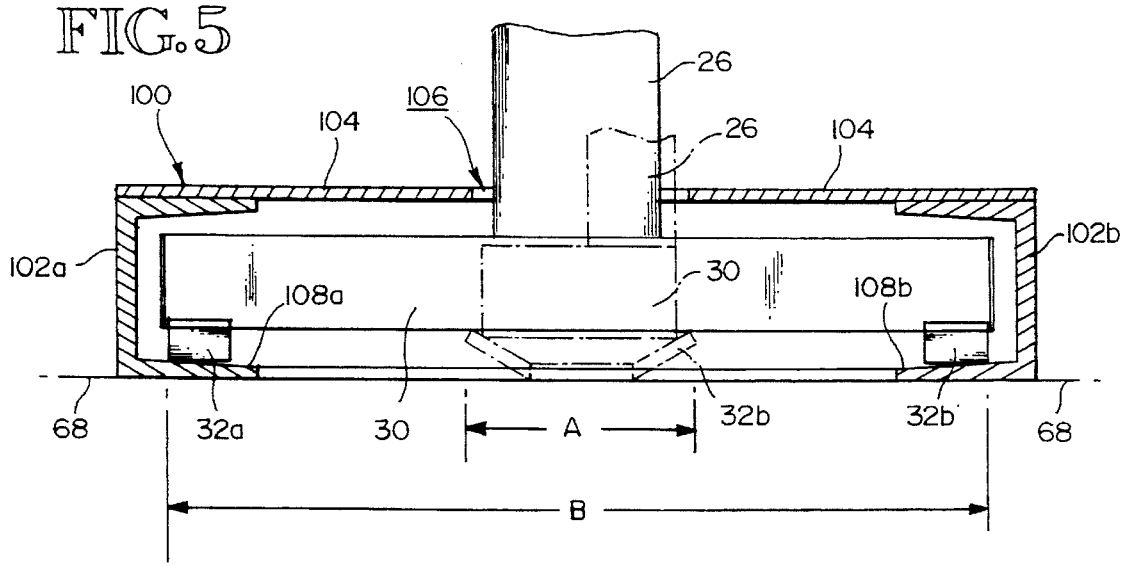

SINGLE EFFORT, DOUBLE ACTION EXERCISE BENCH

FIELD OF THE INVENTION

The present invention pertains to an exercise bench of the type used in conjunction with weight lifting exercises and more particularly to an exercise bench having a pivotal torso support portion mechanically linked to a pivotal seat support portion.

BACKGROUND OF THE INVENTION

Perhaps the most common type of weight lifting exercise accessory is the bench. In its earliest form, it consisted merely of a horizontal surface to support the seat and torso portions of a weight lifter. Using the bench, the lifter could perform exercises that required prone or supine positions, or sitting positions. However, inclined support positions were not accommodated.

In response to this short coming, bench manufacturers produced inclined benches wherein the seat portion remained horizontal and the torso portion was inclined. These inclined benches allowed a lifter to perform additional lifting exercises such as the inclined press and the inclined fly. The natural evolution of this process brought about the adjustable bench. In these embodiments, a lifter could determine the degree of torso elevation relative to the seat portion and to the bench supporting surface.

As more attention was given to the biomechanics of weight lifting, it was determined that the angle of the seat portion relative to the horizontal was an often overlooked aspect of bench design. Moreover, it was realized that declining benches, i.e., those benches wherein the seat portion and the torso portion are angled towards the superior of a lifter, provided additional exercise opportunities. In response, recent benches provided for adjustment of the seat portion and the torso portion of the bench, both for inclination and declination.

SUMMARY OF THE INVENTION

The present invention relates to a multiple inclination exercise bench and is characterized as having a pivotal torso support portion operatively linked to a pivotal seat support portion. In particular, the bench comprises at least one vertical supporting member connected to a support member. Mounted to the bench is a first pivot location about which pivots a torso supporting assembly at its proximal end and a second pivot location about which pivots a seat supporting assembly at its proximal end. The torso supporting assembly is preferably supported distally by a strut assembly that pivotally connects the torso supporting assembly with the support member via a releasable locking mechanism. The seat supporting assembly is preferably supported distally by a lever assembly.

The lever assembly comprises a lever arm that pivots on a shaft or other rotation permitting member and has a seat supporting portion at one end and a cam follower portion at the other end. At least one cam plate is fixedly attached to the proximal end of the torso supporting assembly so that pivotal movement of this assembly causes the cam plate to similarly pivot about a fixed point. The cam follower portion of the lever assembly rides the contour of the cam plate and translates rotational motion of the cam plate into a linear force that causes the lever arm to pivot. In response to pivoting of the lever arm, the seat supporting portion of the lever assembly causes elevational differences in the distal portion of the seat supporting assembly. Thus, as the torso supporting assembly is pivoted about the central shaft, the pivotal movement of the cam causes predetermined elevational differences to manifest in the seat supporting portion without the need for separate adjustment.

A feature of the invention utilizes a ratchet channel and pin combination as the releasable locking mechanism. A centrally located slot exists in the support member through which extends a portion of the strut assembly and a release handle. The ratchet channel is pivotally mounted at one end to the bench and is disposed internal to the support member. The extending portion of the strut assembly selectively engages with notches formed in the ratchet channel, thereby opposing the natural downward sliding motion of the extending portion. The torso supporting assembly can be further inclined until the last notch is engaged by the extending portion of the strut assembly. To permit the torso supporting assembly to reach less inclined positions, the release handle causes the ratchet channel to displace from the support member, thus permitting the extending portion to become dislodged from the notch.

BRIEF DESCRIPTION OF THE DRAWINGS

FIG. 4 is a cross sectional view taken substantially along the line 4—4 of FIG. 3; and FIG. 5 is a partial sectional view of a support member of the invention taken substantially along the line 5—5 of FIG. 1 wherein the insertion position is shown in phantom.

DESCRIPTION OF THE INVENTION

Figure 1:
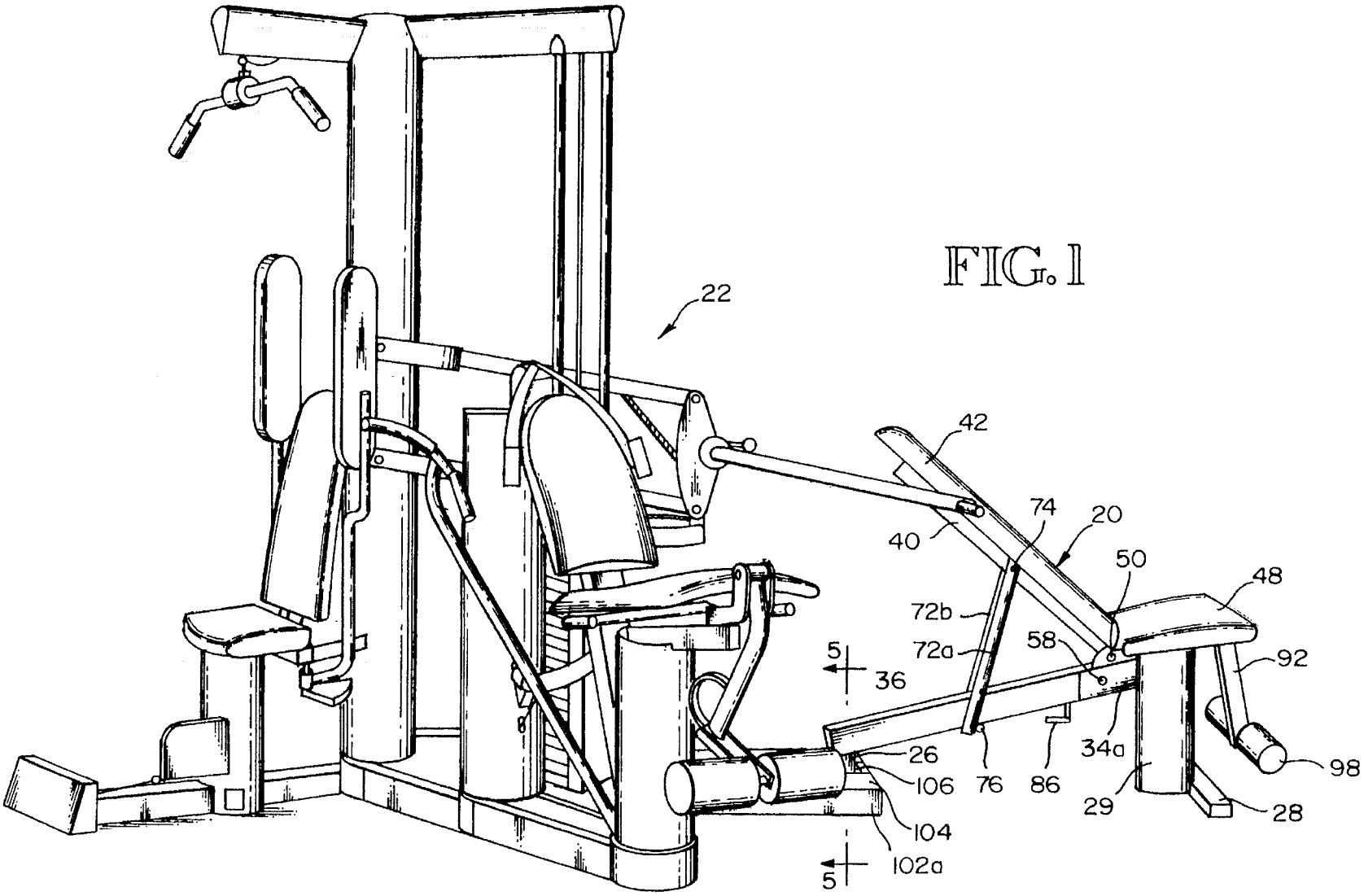
FIG. 1 is a perspective view of the invention when in use with a weight lifting machine.

Unless otherwise indicated or illustrated, all parts are steel and parts referenced as being attached or connected are preferably welded or bolted together. Referring then to the several figures wherein like numerals indicate like parts and more particularly to FIGS. 1, 2, and 3 the overall attributes of the invention are shown. Bench 20 is shown in use with weight machine 22 in FIGS. 1 and 2, and generally comprises vertical support column 24 to which is attached horizontal stabilizer 28; vertical support post 26, horizontal stabilizer 30, and skids 32*a* and 32*b* similarly attached together; flanged torso channel 40 to which is bolted pad 42; seat tube 44 with cross members 46*a* and 46*b* attached thereto thereby permitting a stable surface for the mounting of seat pad 48; support plates 34*a* and 34*b* to which is fixedly attached support member 36; torso support assembly 70 which will be described in detail below; and optional lower leg brace 90.

Figure 2:
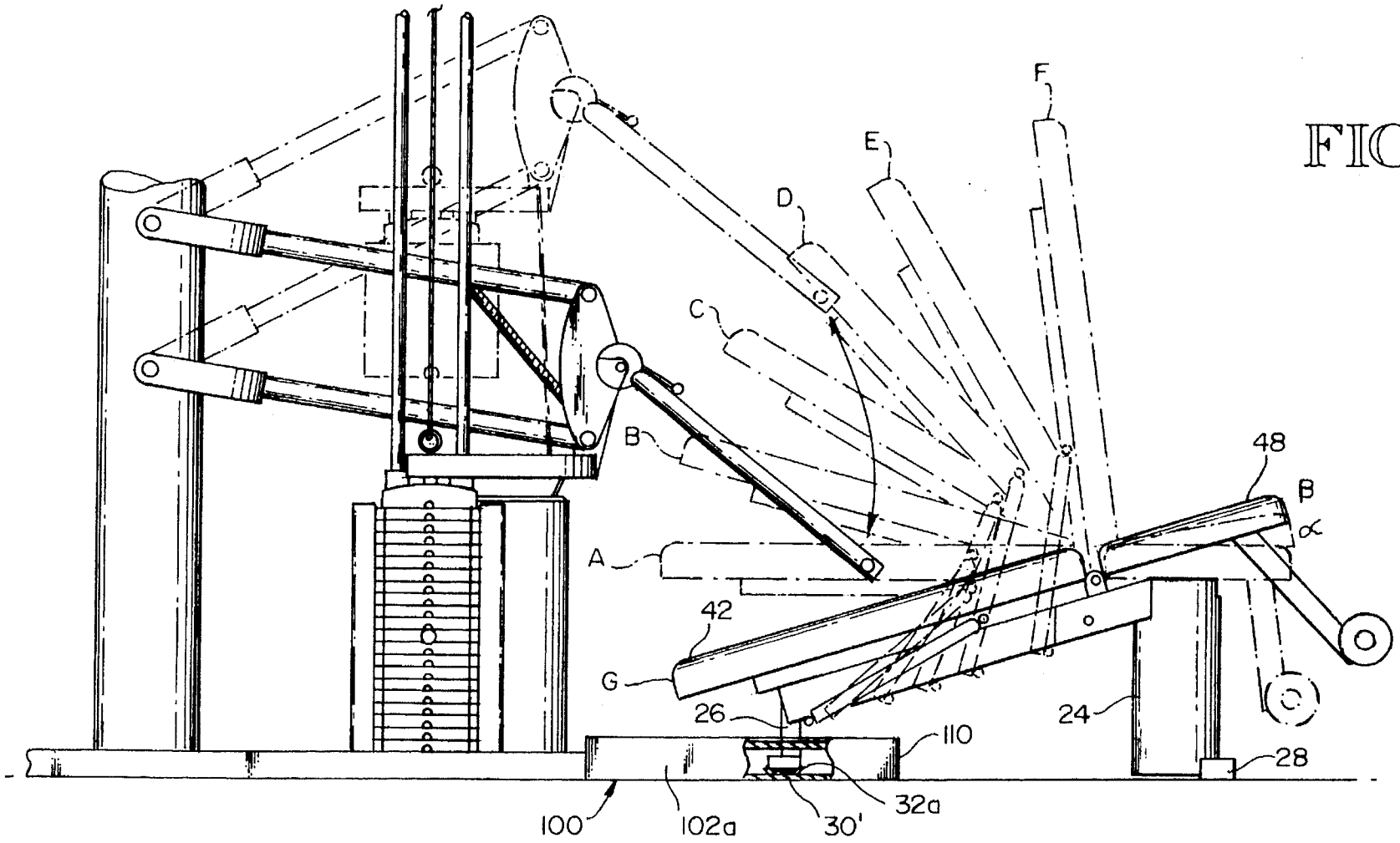
FIG. 2 is an elevation view of the bench in FIG. 1 wherein an overall 15° declination of the bench is shown at position G and the various states of torso support inclination are shown in phantom as positions A–F.

As best shown in FIG. 2, bench 20 can be positioned for seven discrete torso elevations. In position A, both torso pad 42 and seat pad 48 are parallel to supporting surface or floor 68. Whenever torso pad 42 is inclined, e.g. positions B–F, seat pad 48 inclines approximately 10° (shown as position $\alpha$) to provide a more acute angle between it and torso pad 42. This slight elevation of seat pad 48 helps to prevent a user from unintentionally sliding off this supporting assembly. In position G, torso pad 42 declines approximately 15° and seat pad 48, shown in position β, assumes a 15° incline so that the two pads are substantially coplanar.

Figure 3:
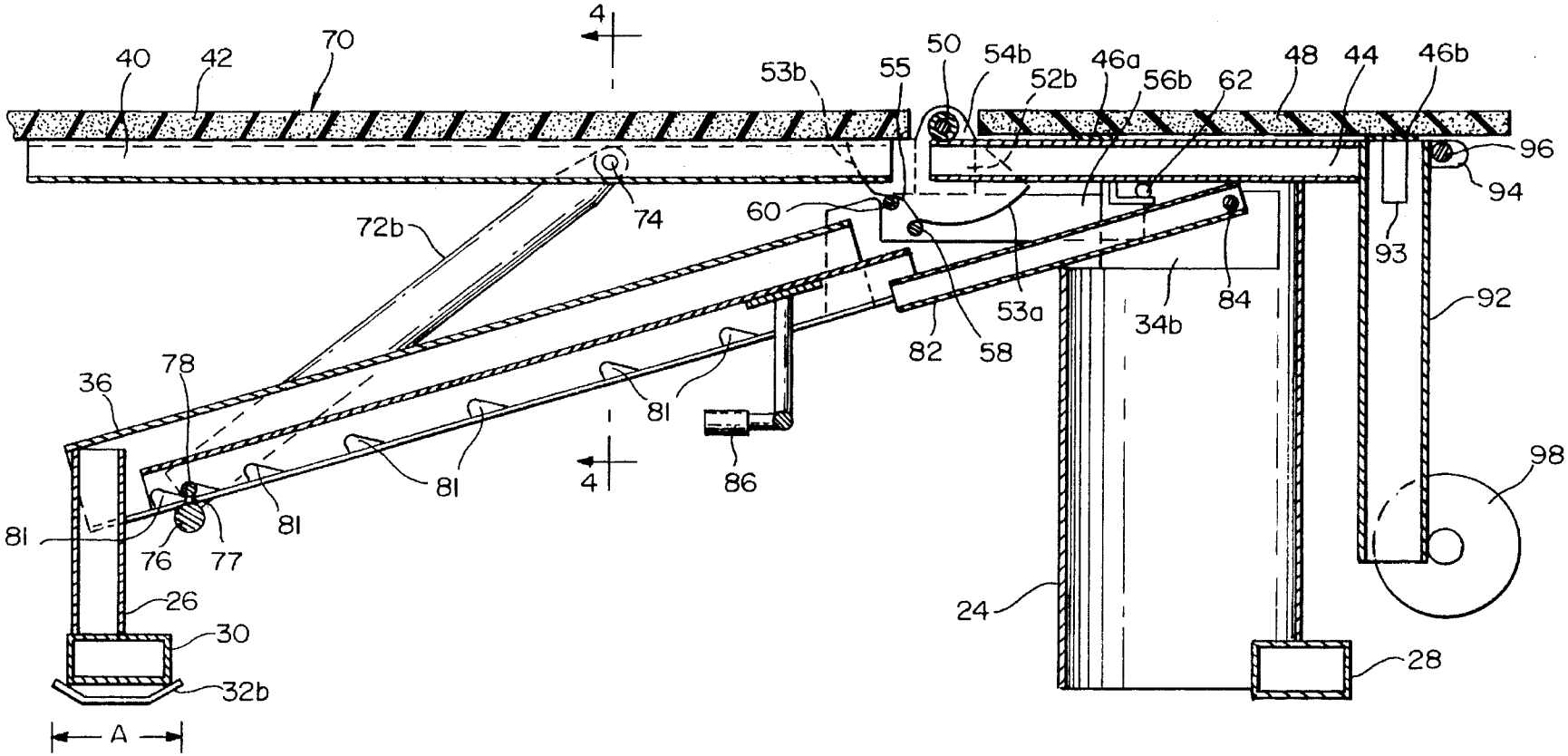
FIG. 3 is a cross sectional view of the invention taken along its median longitudinal axis.

In order to better understand the configuration of the invention, attention is drawn to FIG. 3 wherein a cross section of bench 20 is shown. In addition to the previously referenced parts, bench 20 also has torso support assembly 70 comprising torso supporting struts 72*a* and 72*b* pivotally mounted to flanged torso member 40 via shaft 74 and slidingly engagable with support member 36 via shaft 76 and pin 78. Pin 78, which is attached to shaft 76 by connection element 77, rides the interior or return portion 37 of support member 36 as is best shown in FIG. 4. Thus, compression forces on struts 72*a* and 72*b* are transferred to support member 36 via pin 78.

To prevent downward sliding movement of shaft 76 and pin 78 upon loading of torso support assembly 70, ratchet member 80 is pivotally connected to support plates 34*a* and 34*b* at shaft 84 by rigid extension member 82. Because ratchet member 80 is brought to bear against return portion 37 of support member 36 by gravity, declining movement of pin 78 will result in its positive location in the nearest downwardly located notch 81. Thus, flanged torso member 40 is maintained at any predetermined elevation by the positive location of pin 78 in any notch 81 formed in ratchet member 80. In order to release pin 78 from any notch 81, an upward force is applied to handle 86 which causes an upward pivotal movement of ratchet member 80 and subsequent release of pin 78.

During use of bench 20, a user can elevate flanged torso member 40 via torso pad 42. Flanged torso member 40 is preferably welded to cam plates 54 (54*b* being shown) which are pivotally mounted to shaft 50. Shaft 50 is supported by tabs 52 (52*b* being shown in phantom) which are securely attached to support plates 34 (34*b* being shown). Seat tube 44 is also pivotally mounted to shaft 50. Cam plates 54 have a valley portion 55 formed on the peripheral surface. The means by which elevational changes of flanged torso member 40 effect elevational changes in seat tube 44 will now be described.

Elevational changes of seat channel 44 and seat pad 48 are caused by the interaction of cam plates 54 with lever 56. Cam follower 60 is supported by levers 56*a* (not shown in this FIG. for clarity) and 56*b* and is in adjacent contact with cam plates 54. When cam follower 60 is located in valleys 55 of each cam plate 54, there is no torque moment acting on levers 56. However, when flanged torso channel 40 and torso pad 42 are either inclined or declined from the horizontal position, cam plates 54 are caused to pivot about shaft 50 which cause the relative radial displacement of cam follower 60 which in turn causes levers 56 to pivot about pivot shaft 58. This pivoting of levers 56 results in seat supporting member 62 sweeping an arcuate path and imparting increased supporting force to the bottom portion of seat channel 44. This force is translated to pivotal motion of seat channel 44 about shaft 50 to which seat channel 44 is located. Thus, whenever cam follower 60 is in valleys 55, the seat portion of bench 20 is parallel to supporting surface 68. When cam follower 60 is present on arcuate cam portion 53*a* of cam plates 54, the seat portion of bench 20 is inclined approximately 10°; when cam follower 60 is present on arcuate cam portion 53*b* of cam plates 54, the seat portion of bench 20 is inclined approximately 15°.

From the foregoing it can be seen that a variety of seat inclinations can be accomplished by modifying the features of cam plates 54. The present configuration provides for seat portion inclinations of approximately 10° in all positions except for when the torso portion is parallel with the bench supporting surface, or when torso channel 40 is declined 15°.

An optional attachment to bench 20 is lower leg brace 90 which generally comprises extension member 92 and ankle pads 98. Extension member 92 is pivotally connected by shaft 96 to tabs 94 which are welded to seat member 44. When a person desires to conduct exercises that would benefit by an enhanced interaction with the bench, the anterior portion of the person's ankles flex around pads 98 to provide the desired stabilization. Stopper 93 is disposed internal to extension member 92 and attached to seat tube 44 so as to prevent excessive pivotal movement of member 92 when lower leg brace 90 is in use.

It was shown in FIGS. 1 and 2 that bench 20 can be used with weight machine 22. FIG. 5 details the interaction between vertical support post 26 and related horizontal stabilizer 30, and platform 100 of weight machine 22. Platform 100 generally comprises members 102*a* and 102*b* which are held in spaced apart relation by user supporting surface 104. Formed in supporting surface 104 is slot 106 which has a gap width approximately the same as the maximum width of horizontal stabilizer 30 which is indicated by line A in FIGS. 3 and 5, and a length at least equal to that of horizontal stabilizer 30 which is indicated by line B in FIG. 5.

To integrate bench 20 with weight machine 22, vertical support post 26 and related horizontal stabilizer 30 are inserted into slot 106 approximately 90° from the normal orientation as shown in phantom in FIG. 5. Bench 20 is then rotated approximately 90° to achieve its desired normal operating position. During this rotation, skids 32*a* and 32*b* transition or ramp horizontal stabilizer 30 up to the internal portion of the lower flanges 108*a* and 108*b* of channel members 102*a* and 102*b*. By locating horizontal stabilizer 30 in platform 100, unintentional tippage of bench 20 is almost entirely prevented.

Alternatively, end 110 (see FIG. 2) of platform 100 can be exposed so that horizontal stabilizer 30 can be inserted therethrough. In this manner, a user need not lift bench 20 in order to realize the benefits of locating the stabilizer therein. The foregoing structures are illustrative of the present invention. Those persons skilled in their art will appreciate that numerous variations are possible and contemplated by the inventor.

What is claimed is:

1. An adjustable elevation bench for use in exercising comprising:

at least one supporting member connected to a longitudinal member wherein an end portion of the at least one supporting member is in contact with a bench supporting surface;

a torso supporting assembly pivotal at a proximal end about the longitudinal member at a first pivot point and having a distal end generally opposite thereto;

a seat supporting assembly pivotal at a proximal end about the longitudinal member at a second pivot point and having a distal end generally opposite thereto;

at least one strut to support the distal portion of the torso supporting assembly, the at least one strut being engagable with a releasable locking mechanism wherein the releasable locking mechanism selectively permits variable inclination and declination from the horizontal of the torso supporting assembly;

a lever assembly pivotally mounted to the bench having a cam follower portion at a first end and a distal seat supporting portion at a second end; and at least one cam plate fixedly attached to the proximal end of the torso supporting assembly and in engaging contact with the cam follower portion of the lever assembly wherein the at least one cam plate has a valley portion adjacent to at least one arcuate portion whereby the torso supporting assembly and the seat supporting assembly are in a first relative configuration when the cam follower portion of the lever assembly is located in the valley portion, and the torso supporting assembly and the seat supporting assembly are in at least a second relative configuration when the cam follower portion of the lever assembly is located out of the valley portion.

2. The bench of claim 1 further comprising a common shaft, rigidly mounted to the bench to provide for the pivotal mounting of the proximal end of the torso supporting assembly and the pivotal mounting of the proximal end of the seat supporting assembly wherein the first pivot point coincides with the second pivot point.

3. The bench of claim 1 wherein the releasable locking mechanism comprises a ratchet member proximally mounted to the longitudinal member and defining a plurality of notches, and the at least one strut has a pin mounted thereto whereby selective engagement of the pin with the ratchet member notches prevents movement of the torso supporting assembly so as to establish a locked position.

4. The bench of claim 3 wherein the ratchet member is pivotally connected to the bench at one end, and the plurality of notches are oriented towards the longitudinal member, whereby, in locked position, a surface of the longitudinal member is adjacent to the plurality of notches so as to hold the pin captive.

5. The bench of claim 4 wherein the longitudinal member is characterized as having a rectangular cross section and defining a longitudinal slot, and the ratchet member is disposed internally of the longitudinal member, whereby a connecting element links the at least one strut to the pin so as to permit the pin to be engagable with the plurality of notches, and wherein the releasable locking mechanism further comprises a handle extending through the slot to provide a means for causing pivotal motion of the ratchet member to thereby release the pin from any one of the plurality of notches.

6. The bench of claim 1 further comprising a lower leg brace assembly pivotally attached to the distal end of the seat supporting assembly.

7. The bench of claim 1 further comprising a lateral bench support fixedly attached to the at least one supporting member and characterized as having a pair of longitudinally mounted skids attached thereto.

8. An adjustable elevation bench for use in exercising comprising:

at least one supporting member connected to a longitudinal member characterized as having a generally rectangular cross section and defining a longitudinal slot on a bottom portion thereof wherein an end portion of the at least one supporting member is in contact with a bench supporting surface;

a torso supporting assembly pivotal at a proximal end about a first shaft fixedly and transversely attached to the bench;

a seat supporting assembly pivotal at a proximal end about the first shaft;

at least one strut to support a distal portion of the torso supporting assembly, the at least one strut being engagable with a releasable locking mechanism comprising a ratchet member mounted to the longitudinal member and defining a plurality of notches with gaps, and the at least one strut has a pin mounted thereto whereby selective engagement of the pin with the ratchet member notches prevents movement of the torso supporting assembly so as to establish a locked position;

a lever assembly pivotally mounted to the bench having a cam follower portion at a first end and a distal seat supporting portion at a second end; and at least one cam plate fixedly attached to the proximal end of the torso supporting assembly and in engaging contact with the cam follower portion of the lever assembly wherein the at least one cam plate has a valley portion adjacent to at least one arcuate portion whereby the torso supporting assembly and the seat supporting assembly are in a first relative configuration when the cam follower portion of the lever assembly is located in the valley portion, and the torso supporting assembly and the seat supporting assembly are in at least a second relative configuration when the cam follower portion of the lever assembly is located out of the valley portion.

9. The bench of claim 8 comprising two linked struts, each strut being engagable with the releasable locking mechanism wherein each strut is connected at a first end by a common shaft to which is attached the pin for selective engagement with the ratchet member.

* * * * *